United States Patent [19]

Wagner

[11] 4,194,494

[45] Mar. 25, 1980

[54] FIREPLACE PLUG

[76] Inventor: Cyril Wagner, 856 Rosemary Ter., Deerfield, Ill. 60015

[21] Appl. No.: 848,764

[22] Filed: Nov. 4, 1977

[51] Int. Cl.[2] ..... F23J 13/08

[52] U.S. Cl. ..... 126/319; 138/89; 292/251.5

[58] Field of Search ..... 126/319; 292/251.5; 138/89; 285/9 M; 220/230

[56] References Cited

U.S. PATENT DOCUMENTS

| | | | |
|---|---|---|---|
| 182,667 | 9/1876 | Higgins | 126/319 |
| 1,266,497 | 5/1918 | Larson | 126/319 |
| 1,620,840 | 3/1927 | Southard | 126/319 |
| 2,147,482 | 2/1939 | Butler | 292/251.5 X |
| 3,434,318 | 3/1969 | Thiry | 292/251.5 X |
| 3,821,969 | 7/1974 | Sinko | 138/89 |

FOREIGN PATENT DOCUMENTS

| | | | |
|---|---|---|---|
| 5234 | 6/1892 | Switzerland | 126/319 |

*Primary Examiner*—Nile C. Byers, Jr.
*Attorney, Agent, or Firm*—Fitch, Even & Tabin

[57] ABSTRACT

A fireplace plug is provided for closing the metallic throat of a fireplace during periods of nonuse. The plug has a body, for obstructing the throat, which carries a magnetic means for securing the body to the throat. The plug further provides a handle for ease in inserting the plug into the throat and an indicating means for indicating that the plug has been inserted into the throat of the fireplace.

4 Claims, 6 Drawing Figures

FIREPLACE PLUG

The present invention relates to fireplace closure devices and more particularly to closure devices for fireplaces having a metallic throat.

Fireplaces usually have a chimney or chimney pipe for providing ventilation to a fire contained within the firebox of the fireplace. The chimney also directs smoke away from the firebox up through the roof of the structure in which the fireplace is contained. However, when the fireplace is not in use, downdrafts can occur through the chimney causing drafts within the room and scattering ashes from the firebox. Furthermore, heat from the room can escape up the chimney.

Prior attempts to close the chimney when the fireplace is not in use have included relatively complicated mechanical devices such as dampers. Dampers are usually constructed of metal having a movable plate for regulating the draft. These dampers are not only relatively expensive to manufacture but are also difficult to install. Furthermore, they have not provided a good seal against air leaks, heat loss and insect entry.

Thus, a highly practical fireplace closure device should be adapted to fit existing fireplaces. Because fireplaces are inherently sooty, the closure device should be installed without the user becoming dirty or requiring elaborate time consuming installation efforts in a dirty environment. In addition, it should be inexpensive and also lightweight since it will likely be used by women or children. Furthermore, it should provide a good seal against drafts, heat loss, insect passage and the like.

It is an object of the present invention to provide a closure device obviating, for practical purposes, the abovememtioned limitations heretofore present.

Other objects and advantages of the invention are more particularly set forth in the following detailed description and in the accompanying drawing, of which:

Figure 1:
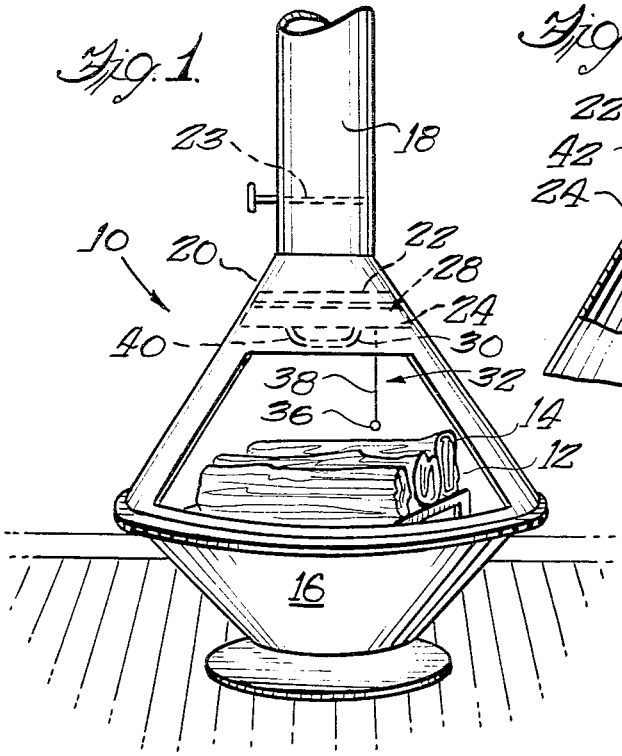
FIG. 1 is a pictorial view of a fireplace employing a preferred embodiment of the present invention in an active position.

With reference to FIG. 1, a fireplace 10 is shown having a firebox 12 containing logs 14 and supported by a base 16. Fireplace 10 also has a chimney pipe 18 and a metallic throat 20 shaped like the frustrum of a cone (but may have any desired shape) connected to the chimney pipe 18 over firebox 12 for directing smoke to the chimney pipe from the fire. Fireplace 10 may, of course, have a chimney instead of a chimney pipe and may have various shapes, but modern fireplaces usually have, in common, a sheet metal throat 20.

As mentioned above, heat may be lost up chimney pipe 18 when the fireplace is not in use. Also, insects may enter and air leaks occur around a damper 23. With fireplce plug 22 positioned within throat 20, these problems are substantially reduced.

In accordance with the present invention, a good tight sealing closure of the fireplace may be achieved by insertion of an inexpensive, lightweight fireplace plug 22 to cover the throat 20 and to have intimate sealing contact with or about the metallic fireplace throat. Although the fireplace is a sooty and dirty environment, the plug 22 may be easily installed and removed without getting excessively dirty. This is achieved by forming a graspable handle means 30 on the underside of the plug for easy manual manipulation for shoving of the plug into its active position and for pulling from the active position and by using a magnetic means 28 on the plug to secure the plug to or about the metallic fireplace throat. The magnetic means is preferably an encircling ring or band on the plug to provide a continuous and encircling tight seal between the plug and the metallic throat without requiring the use of any fasteners or other securing devices which would be difficult to apply within a fireplace. To alert the fireplace user not to start a fire while the plug is in use, an indicator means 32 depends from the plug into a readily visible position to flag the fireplace user of the plug's presence. As will be explained, the plug is lightweight, inexpensive and easy to use making it a commercially feasible product.

Figure 2:
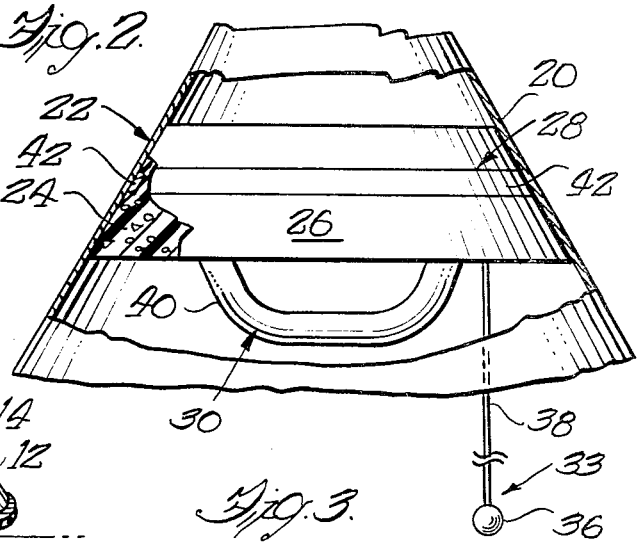
FIG. 2 is a closeup view of the embodiment of the invention shown in FIG. 1 with a portion broken away.
Figure 3:
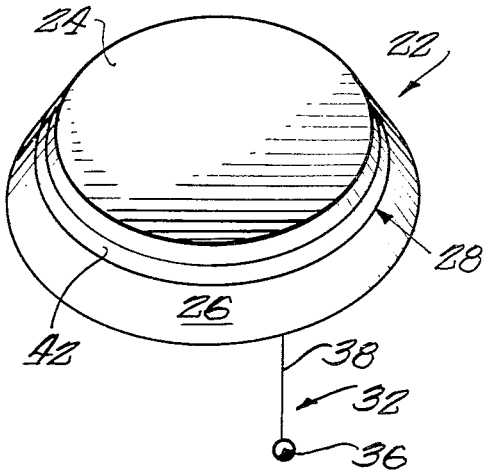
FIG. 3 is a pictorial view of the embodiment shown in FIG. 1 free of the fireplace.

Referring now to FIGS. 2 and 3, fireplace plug 22 is shown generally comprising a body 24 insertable into an active position within throat 20 (FIG. 2), being of a predetermined size, such that body 24 substantially obstructs the throat, and body 24 having a wall 26 of a predetermined shape for engaging the throat. The shape of wall 26 is substantially determined by the shape of throat 20. Plug 22 further comprises a magnetic means 28 carried by the body for securing wall 26 of body 24 to the throat when the body is in the active position.

In the preferred embodiment, body 24 is molded from lightweight but highly insulative polyurethane foam. Furthermore, body 24 has an appropriate thickness to provide adequate insulation to prevent heat loss through the chimney pipe from throat 20. In one alternative embodiment, where throat 20 of the fireplace has the shape of a frustrum of a cone, wall 26 of body 24 of fireplace plug 22 similarly has the shape of a frustrum of a cone. Thus wall 26 has a shape complementary to the shape of throat 20 so that wall 26 can mate with throat 20. Body 24 therefore, in this embodiment, fits within the throat and substantially obstructs or fills the throat when the body is in the active position.

Indicator means 32 indicates that the body is in the active position so that the user does not attempt to start a fire when the plug is in position. Indicator means 32 comprises a second body 36 and a connecting means comprising a string 38 of a predetermined length for connecting the second body to the first body. The length of string 38 is determined by the size of throat 20 so that second body 36 may extend and hang outside the throat in order to be visible when the first body 24 is in the active position as shown in FIG. 1. Body 36 is molded from polyurethane foam in the shape of a ball and is painted red to further enhance visibility.

As shown in FIG. 2, handle means 30 provides a grip for inserting the plug into the throat of the fireplce and comprises a U-shaped bar 40, which also may be constructed of polyurethane foam, and integrally connected to the underside of body 24. Handle means 30 allows body 24 to be grasped and manipulated so that the body may be inserted and removed without the user getting dirty from the soot in the fireplace. Bar 40 is constructed sufficiently large so that it can be readily found when plug 22 is not visible (as in FIG. 1).

Magnetic means 28 secures wall 26 to throat 20 and comprises a continuous strip 42 of magnetic material embedded into wall 26 such that strip 42 lays flush with wall 26. Strip 42 adheres to the metallic throat when body 24 is in the active position. The magnetic material of strip 42 may be either metallic or ceramic. Thus continuous strip 42 provides a good metal to metal or ceramic to metal seal, respectively, with throat 20. Such an intimate seal provides a better seal than a damper blade which may leave cracks through insects or air may easily pass.

Figure 6:
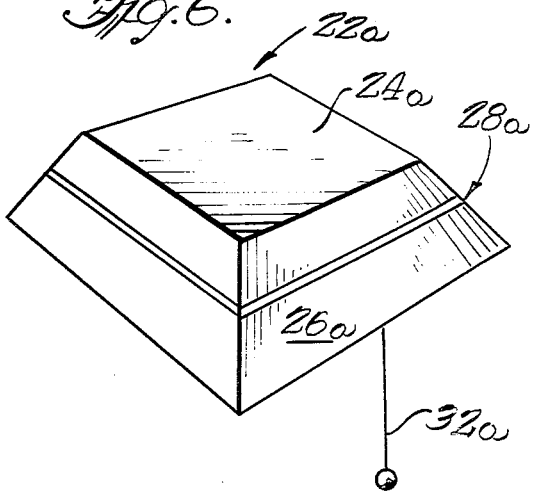
FIG. 6 is a pictorial view of still another alternative embodiment of the present invention.

An alternative embodiment of the present invention for use with a fireplace having a throat shaped like a frustrum of a pyramid is shown in FIG. 6. Fireplace plug **22*a* is similar in structure and function to fireplace plug 22 and hence similar reference characters with a suffix "a" will be used to describe elements similar to those previously described in connection with fireplace plug 22. Wall 26*a* of body 24*a* is similarly shaped like the frustrum of a pyramid so as to be complementary to the throat so that plug 22*a* may fit within the throat and the magnetic means 28*a* achieves an intimate contact with the wall of the throat. A handle means (not shown) and an indicator means 32*a*** are also provided.

Figure 4:
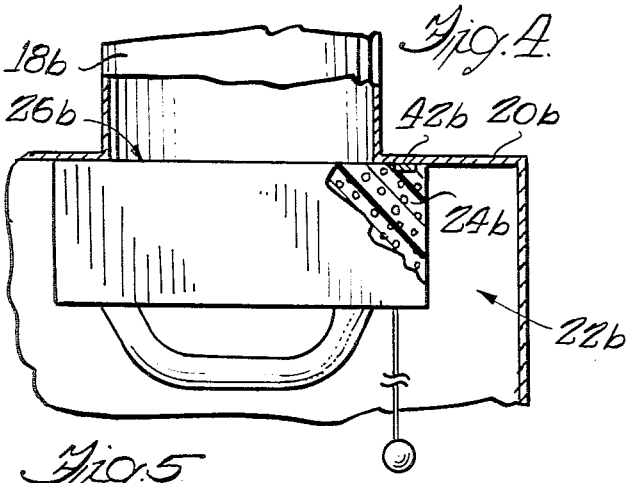
FIG. 4 is a closeup view of a fireplce employing the present invention in an alternative embodiment with a portion broken away.

With reference to FIG. 4, still another alternative embodiment of the present invention is illustrated and a suffix "b" has been added to describe elements similar to those described in connection with the first described embodiment of the invention. Fireplace plug **22*b* is used here with fireplces having a substantially flat or planar throat 20*b* near the opening of the chimney pipe 18*b*, such as Franklin stoves and the like. Here, wall 26*b* of body 24*b* is also substantially flat so that wall 26*b* may lay flush and mate with throat 20*b* when body 24*b* is in the active position. Thus, body 24*b* obstructs the throat 20*b* of chimney pipe 18*b* by covering the opening of the chimney pipe to provide a seal. Here also magnetic strip 42*b* is embedded flush with wall 26*b*** and achieves an encircling tight seal about the throat.

Figure 5:
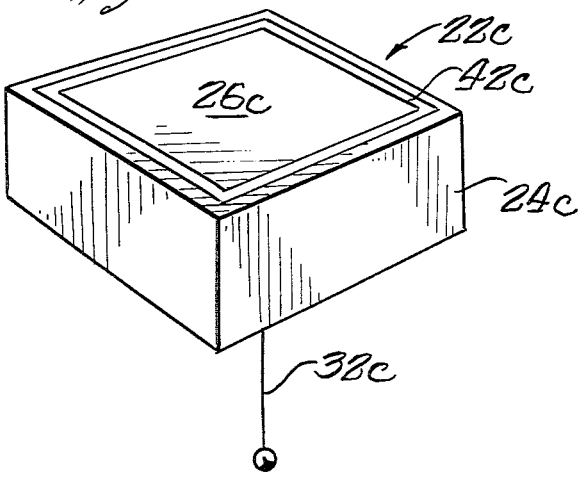
FIG. 5 is a pictorial view of another alternative embodiment of the invention.

Another alternative embodiment of the present invention for use with fireplaces having a flat throat is shown in FIG. 5. Body **24*c* and wall 26*c* are substantially rectangular so that plug 22*c*** may accommodate rectangular chimney pipes or chimneys as well as round ones.

As can be seen above, the present invention provides a fireplace plug that is lightweight, uncomplicated, and economical to manufacture. Yet, the plug efficiently prevents drafts and heat loss through the chimney.

It will, of course, be understood that modifications of the present invention, and its various aspects, will be apparent to those skilled in the art, some being apparent only after study, and others being merely matters of routine mechanical design. As such, the scope and invention should not be limited by the particular embodiments and specific constructions herein described, but should be defined only by the appended claims, and equivalents thereof.

Various features of the invention are set forth in the following claims.

I claim:

1. A fireplace plug for closing the metallic throat of a fireplace during periods of nonuse comprising:

a plug shape foam body having a wall complementary to the shape of the fireplace throat for mating with said throat;

a substantially continuous magnetic strip extending along said wall for magnetic attraction to the metallic throat and for securing the wall to the throat;

a handle depending from the underside of said body; and a depending indicator means hanging downwardly from the body for indicating that the fireplace plug has closed the throat of the fireplace.

2. A fireplce plug for closing the metallic throat of a fireplace during periods of nonuse comprising:

a body insertable into an active position such that the body substantially obstructs said throat, said body being of a predetermined size, said body having a wall of a predetermined shape for engaging said throat, the shape of the wall being substantially determined by the shape of the throat, magnetic means carried by the body for securing the wall of the body to said throat, when the body is in the active position, and an indicator means depending downwardly from the body for indicating that the body is in the active position.

3. The apparatus of claim 2 wherein the indicator means comprises:

a second body, and a connecting means of a predetermined length for connecting the second body to the first body so that the second body extends outside the throat and is visible when the first body is in the active position.

4. A fireplace plug for closing a fireplace opening during periods of nonuse comprising:

a body of frusto-conical shape having a tapered side wall for abutting in sealing relationship a wall defining the fireplace opening, a large diameter end on said body, a handle means carried on the large diameter for providing a grip for the manual insertion of the body into the fireplace opening, and a magnetic strip means encircling said tapered side wall and embedded therein for magnetic attraction to said fireplace wall.

* * * * *